United States Patent [19]

Burns et al.

[11] 4,186,453

[45] Feb. 5, 1980

[54] RESTRAINT PACKAGE

[75] Inventors: John E. Burns, Seaford; Martin J. Van Lith, Kew, both of Australia

[73] Assignee: Alfred Hospital, Victoria, Australia

[21] Appl. No.: 888,781

[22] Filed: Mar. 21, 1978

[30] Foreign Application Priority Data

Mar. 22, 1977 [AU] Australia ..... PC9510

[51] Int. Cl.[2] ..... A62C 7/00

[52] U.S. Cl. ..... 5/82 R; 5/494

[58] Field of Search ..... 5/82 R, 91, 317 R, 494; 2/69.5; 206/527; 169/1 R; 150/52 E; 280/19

[56] References Cited

U.S. PATENT DOCUMENTS

| | | | |
|---|---|---|---|
| 2,350,573 | 6/1944 | Smith et al. | 5/82 R |
| 2,703,412 | 3/1955 | Stone | 5/82 R |
| 3,158,875 | 1/1964 | Fletcher | 5/82 R |
| 3,751,742 | 8/1973 | Worley | 5/317 R |
| 3,828,856 | 8/1974 | Wallis | 206/527 |

*Primary Examiner*—Casmir A. Nunberg

*Attorney, Agent, or Firm*—Schwartz, Jeffery, Schwaab, Mack, Blumenthal & Koch

[57] ABSTRACT

A restraint package has a plurality of elongate bands comprising a base member and an overlying cover member interconnected to form an envelope for containing the restraint in a predetermined configuration. The cover has openable portions which when opened expose at least the ends of the bands facilitating the removal from the envelope.

8 Claims, 5 Drawing Figures

RESTRAINT PACKAGE

BACKGROUND OF THE INVENTION

This invention relates to packages for restraints for use in association with hospital beds or the like, such as evacuation restraints of the type described in our Australian Pat. application No. 25673/77, but not restricted thereto.

The evacuation restraint described in the above Application includes a plurality of bands adapted to be passed around a mattress and patient so that the mattress can be deformed and retained in the shape of a cocoon around the patient to protect the patient during an evacuation or other emergency procedure. It was envisaged that the restraint would be located on the wire mattress or steel base support of the hospital bed until it was required, with the long bands folded and held together by a plastic sleeve. However, this was found to create difficulties in that the beds were rendered difficult to make and the restraint was sometimes not properly positioned for rapid use in an emergency. Furthermore, it was found difficult to keep the restraint clear under such conditions.

It is therefore the object of this invention to provide a package for a restraint which does not interfere with the bed to any appreciable extent but which ensures that the restraint is properly positioned for use when required.

SUMMARY OF THE INVENTION

The invention provides a package for a restraint having a plurality of elongate bands, comprising a base member and an overlying cover member interconnected to form an envelope for containing the restraint in a predetermined configuration, said cover member having openable portions which when opened expose at least the ends of said bands for withdrawal from the envelope.

It will be appreciated from the above that the restraint is at least substantially fully enclosed within the envelope whereby the package interferes only minimally with the bed. Furthermore, the envelope may be made of a plastics or other easily cleaned material whereby the second problem referred to above may be overcome.

In one preferred form of the invention, the cover is formed with weakened areas at the positions occupied by the ends of the bands and the ends are made accessible by tearing the weakened areas. Preferably the weakened areas have pull tabs or handles attached thereto or formed integrally therewith to facilitate the tearing operation.

Alternatively some form of closure, such as a zipper or similar fastener, may be used to provide access to the ends of the bands.

The cover is preferably attached to the base around the periphery of the envelope and also at selected positions across the envelope in order to positively locate the bands in their predetermined positions. In this way the restraint enclosed within its package may be positioned in the same orientation under all mattresses whereby the same procedure may be used to gain access to the restraint in an emergency situation.

DETAILED DESCRIPTION OF THE INVENTION

A preferred form of the invention is shown in the accompanying drawings in which.

Figure 1:
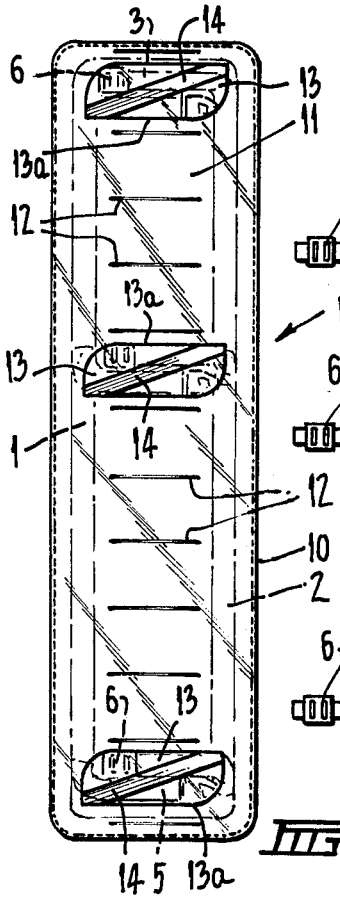
FIG. 1 is a plan view of the package with the restraint in its folded position ready for use.
Figure 2:
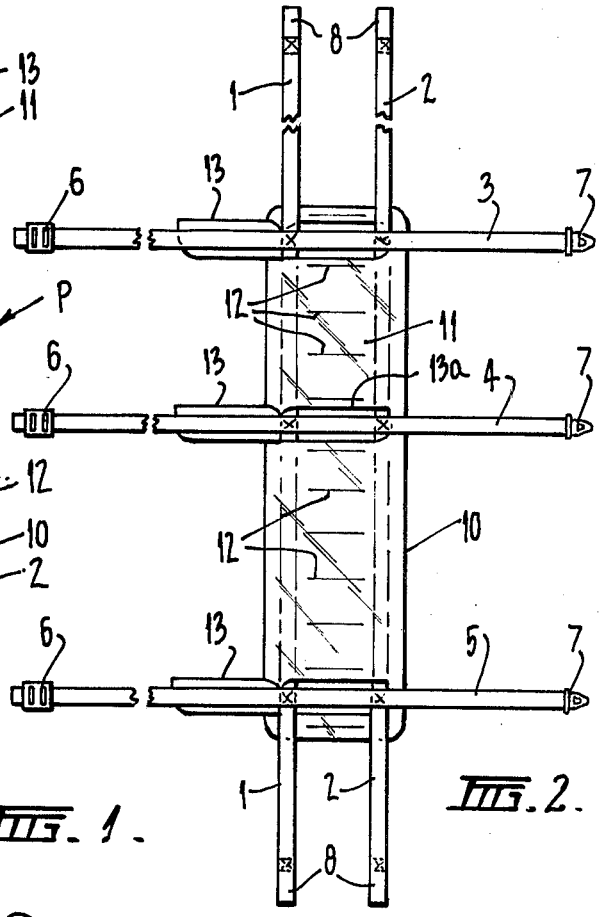
FIG. 2 is a plan view of an opened package showing the restraint unfolded.

The preferred form of package P is shown in FIG. 1 of the drawings and comprises a base member 10 of opaque plastics material, such as yellow plastics, about 355 millimeters wide and about 1370 millimeters long, and a cover member 11 of clear plastics heat welded to the base member 10 around its periphery to define an envelope which fully encloses the restraint shown in more detail in FIG. 2 in the configuration shown in FIG. 1.

The restraint shown in FIG. 2 is substantially identical to the restraint described in our Australian Pat. Application No. 25673/77 and the description of the specification of this application is incorporated herein by cross-reference. The restraint comprises of a pair of spaced longitudinal members 1, 2 which extend in use from past the head and feet ends of the bed, and three transverse members 3, 4, 5 which are connected to the longitudinal members 1 and 2 with the longitudinal members underneath the transverse members. The transverse members 3, 4 and 5 are each provided with cooperating connector members 6, 7 at the ends of the transverse members whereby the ends can be connected to each other and the members can be pulled tight, deforming the mattress in such a manner as to form a cocoon around the occupant of the bed. The longitudinal members are longer than the mattress and are formed into loops 8 whereby the evacuator(s) can pull the restrained person and mattress along the floor.

The cover 11 is heat welded to the base 10 along transverse lines 12 at intervals of about 115 millimeters so that the various transverse bands 3 to 5 and the folded end loops 8 are retained in predetermined positions relative to the base 10, as shown in FIG. 1

The cover member 11 has three removable panels 13, defined by weakening lines 13*a*, overlying the folded bands 3 to 5 and loops 8. Each removable panal 12 has a pull tab or handle 14 extending diagonally across the panel 12 and secured by heat welds at its ends. This heat welding operation preferably defines the weakening lines 13*a* by partly melting through the cover 11. On pulling the handle 14, the cover 11 tears along the weakening lines 13*a* to at least substantially remove the panels 13 (FIG. 2) and expose the bands and connectors for use.

Figure 3:
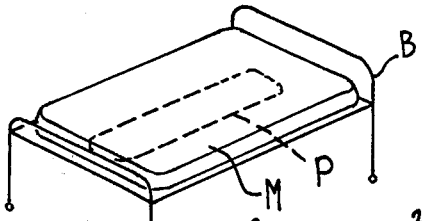
FIG. 3 shows the package in position on a bed.
Figure 4:
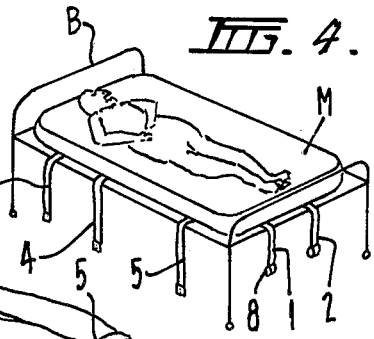
FIG. 4 shows the restraint ready for use.
Figure 5:
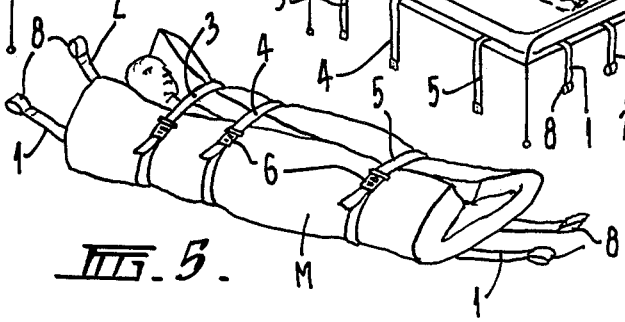
FIG. 5 shows the restraint in use.

In use, the package P is located between the wire mattress of a bed B (FIG. 3) and the usual rubber mattress M for supporting the patient. The package P is substantially narrower than the mattress M and therefore does not interfere with bedmaking procedures. In the event of an emergency, one side of the mattress M is turned back slightly to enable the handles 14 to be gripped and pulled to tear the panels 12 out of the cover 11. The ends of the bands are then withdrawn as shown in FIG. 4 to enable the connectors 6 and 7 to be secured together, whereupon the bands are tightened to coccon the patient within the mattress (FIG. 5).

It will be appreciated that the described package P may be opened in a matter of seconds by means of a transverse tearing action to expose the bands for substantially immediate use. Since the bands are arranged in a predetermined position relative to the base 10 the time taken to operate the restraint is kept to a minimum. Thus, the location of the restraint in the package P not only ensures that the restraint is always properly positioned under the mattress but also enables the restraint to be kept clean in accordance with normal hospital requirements. Furthermore, the package does not interfere with the comfort of the patient since it is narrower than the mattress and is not so bulky as to significantly alter the configuration of the mattress. In fact, in test conducted by the Alfred Hospital, Melbourne, Australia, substantially all patients were unaware that the package was under the mattress and nurses reported no interference with bed making procedures.

It will be appreciated that the package P may have printed instructions thereon and may include an indication of the end of the package to be positioned at the head of the bed. In this way, the package will always be located in the correct position and the correct procedure adopted in the opening of the package.

The restraint may be repackaged in the manner described above after it has been used. In this way replacement costs are kept to a minimum.

The arrangement of the restraint shown in FIG. 2 of the drawing is only one manner in which the various ends of the restraint may be arranged for a subsequent use. The positions adopted by the various parts of the restraint may be changed in any desired manner.

We claim:

1. A package for a restraint having a plurality of elongate bands, comprising a base member and an overlying cover member interconnected to form an envelope for containing the restraint in a predetermined configuration, said cover member having openable portions defined by weakening lines formed in the cover, and manually engageable means attached to each said portion to facilitate manual opening of said portions along said weakening lines which upon said manual opening expose at least the ends of said bands for withdrawal from the envelope.

2. The package of claim 1, wherein said base member and cover member are made from an easily cleaned material.

3. The package of claim 1, wherein said cover is attached to the base at selected positions to prevent excessive movement of the restraint within the envelope whereby the selected positions of the bands is substantially maintained.

4. The package of claim 1, wherein said package is adapted to be located between a mattress and the base of a bed, said package being smaller in width than said mattress whereby the package does not interfere substantially with bed making procedures.

5. A package according to claim 1, containing a restraint comprising at least one longitudinal band or strap member and a plurality of band or strap members secured thereto and extending transversely thereof, said transverse band or strap members being adapted in use to pass around a mattress and the person thereon and having means for quickly connecting the opposite portions thereof together and for quickly adjusting the length of the connected portions whereby the mattress can be deformed into and maintained in a cocoon-like shape about the patient.

6. The package of claim 5, wherein said restraint has two spaced longitudinal bands extending adjacent the long edges of said package, and three transverse bands secured to said longitudinal bands and positioned to extend around the mattress in the vicinity of the chest, hips and lower legs respectively, of the person supported by said mattress, said transverse straps being folded so that said connecting means are located beneath said openable portions,said longitudinal bands extending beyond that mattress and at least one end, and being folded so that their ends are located under one of said openable portions.

7. The package of claim 1 wherein said manually engageable means comprise tearing handles to facilitate manual tearing of said cover.

8. The package according to claim 1 wherein said manually engageable means comprise tearing handles extending diagonally across and attached to each side openable portion.

* * * * *